US006371475B1

(12) United States Patent
Gerhard

(10) Patent No.: US 6,371,475 B1
(45) Date of Patent: Apr. 16, 2002

(54) METHOD AND DEVICE FOR FEEDING INDIVIDUAL SHEETS TO A PRINTER

(75) Inventor: Jakob Gerhard, Brittnau (CH)

(73) Assignee: Hunkeler AG, Wikon (CH)

( * ) Notice: Subject to any disclaimer, the term of this patent is extended or adjusted under 35 U.S.C. 154(b) by 0 days.

(21) Appl. No.: 09/194,876

(22) PCT Filed: May 8, 1998

(86) PCT No.: PCT/CH98/00189

§ 371 Date: Jan. 19, 1999

§ 102(e) Date: Jan. 19, 1999

(87) PCT Pub. No.: WO98/51599

PCT Pub. Date: Nov. 19, 1998

(51) Int. Cl.[7] ..... B65H 5/22; B65H 83/00; B65H 85/00

(52) U.S. Cl. ..... 271/3.08

(58) Field of Search ..... 271/3.08

(56) References Cited

U.S. PATENT DOCUMENTS

| | | | | |
|---|---|---|---|---|
| 3,212,774 A | | 10/1965 | Ingalls | |
| 4,478,400 A | | 10/1984 | Commers | |
| 5,280,896 A | * | 1/1994 | Yamada | 271/3.1 |
| 5,966,556 A | * | 10/1999 | Nakagawa et al. | 399/18 X |
| 5,996,987 A | * | 12/1999 | Leu et al. | 271/3.11 X |

FOREIGN PATENT DOCUMENTS

| | | |
|---|---|---|
| DE | 35 27 277 A1 | 4/1986 |
| DE | 40 12 281 A1 | 10/1991 |
| EP | 0 329 089 A1 | 8/1989 |
| EP | 0 537 596 A2 | 4/1993 |
| GB | 604653 | 7/1948 |

* cited by examiner

*Primary Examiner*—H. Grant Skaggs
*Assistant Examiner*—Kenneth W Bower
(74) *Attorney, Agent, or Firm*—Oliff & Berridge, PLC

(57) ABSTRACT

In a drawer (20) of a high-speed printer, individual sheets (24) supplied in an imbricated stream (30) are fed from below to a stack (22) consisting of individual sheets (24). For continuous feed, a conveying means (28) is arranged in the drawer (22). The individual sheets (24) are transferred to the conveying means (28) from a delivery conveyor (36) at a transition point or interface (38).

16 Claims, 2 Drawing Sheets

METHOD AND DEVICE FOR FEEDING INDIVIDUAL SHEETS TO A PRINTER

BACKGROUND OF THE INVENTION

1. Field of the Invention

The invention relates to a device, formed as an integral part of a printer or copier, which receives fresh individual sheets, on an as needed basis, and supplies these sheets to the printing portion of a printer to be printed. The invention also relates to a method of receiving fresh individual sheets, on an as needed basis, and supplying them to the printing portion of a printer to be printed.

2. Description of the Related Art

It is known in paper processing or printing machines, for example printers or copiers, to store individual sheets in a drawer which can be filled up by hand. One disadvantage of machines of this type, particularly in the case of high-speed machines, is to be seen in that an operator must be continually ready to fill up the drawer again with a stack of individual sheets by hand. Another disadvantage associated with this is the stoppage times until the drawer is filled up again. The performance of such a machine may thereby be restricted considerably.

The publication EP 0,537,596 A2 discloses a copier having an intake interface for an external input compartment. This external input compartment is designed as a lift platform, on which individual sheets are fed in a stacked arrangement to the intake interface. A lift platform of this type is also designated as an "elevator platform". The feed device disclosed in the publication is suitable for being arranged at the intake interface for the external input compartment, in order to replace the existing lift platform. A disadvantage of this known feed device is that it is suitable only to be arranged at the intake interface for the external input compartment.

The term "printer" refers below to a machine which prints and/or processes papers, and a printer of this type may be designed, for example, as a high-speed printer, a copier or a laser printer. The term "internal input compartment" refers below to an input compartment for individual sheets which is arranged within the printer and which is also conventionally designated as a cassette or drawer.

SUMMARY OF THE INVENTION

The object on which the invention is based is to provide an economically more advantageous device for feeding individual sheets to a printer.

The object is achieved, in particular, by means of a cassette or drawer for receiving individual sheets, comprising a conveying means for delivering the individual sheets and a jogging device for forming a stack from the delivered individual sheets, the conveying means and the jogging device being designed to interact in such a way that the individual sheets are fed to the stack from below, and the jogging device being arranged in such a way that, with the cassette or drawer inserted in the printer, the upper part of the stack comes to rest in a position provided for paper offtake.

An extraction device adapted to the cassette is also designated as a "cassette type feed apparatus".

One advantage of the device according to the invention is to be seen in that a printer having an internal input compartment can be operated continuously, and without interruption, with the drawer or cassette according to the invention, since the individual sheets can be fed continuously and, in particular, also at a very high rate. Moreover, there is no need for an operator who lays the individual sheets into the drawer or cassette of the printer.

In a particularly advantageous embodiment, the device according to the invention is designed in such a way that it can be coupled to an existing, older printer. A printer hitherto capable of being supplied with individual sheets only by means of a drawer may thereby be modified in such a way that an automatic sheet feed can be implemented. In this case, the device according to the invention is designed in such a way that, being designed as a separate device or as part of the drawer, it holds a stack of individual sheets in the printer in a position provided for paper offtake, the individual sheets being delivered from outside the printer by a conveying means and being fed automatically to the stack.

One advantage of the device according to the invention is to be seen in that even a printer in which no interface is provided for an automatic feed of individual sheets can be modified in such a way that an automatic feed of individual sheets is possible. The device according to the invention produces a stack consisting of individual sheets in the stack well of the printer, the stack constantly having paper during operation, so that the printer can be operated without interruption. There is preferably no need for any modifications on the printer. The printer always assumes that a full stack of individual sheets is available.

In an advantageous embodiment of the invention, the feed device is arranged in a drawer, in such a way that an existing conventional drawer can be exchanged for the new drawer comprising the feed device. The individual sheets to be fed from outside are preferably fed to the feed device through an already existing orifice in the printer, so that an existing printer can be provided with an automatic feed device cost-effectively and quickly. The feed device arranged in the drawer or the feed device forming part of the drawer can be pulled out and serviced in a simple way.

BRIEF DESCRIPTION OF THE DRAWINGS

An exemplary embodiment of the invention is explained in more detail with reference to the drawing in which.

DESCRIPTION OF THE PREFERRED EMBODIMENT

Figure 1:
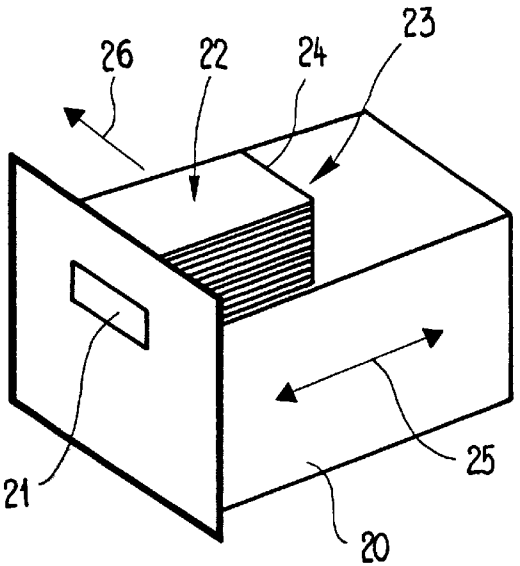
FIG. 1 shows a drawer of a printer of a known type, said drawer receiving a stack of individual sheets.

FIG. 1 shows a stack well 23 of a high-speed printer not illustrated, preferably a laser printer, which is designed with a drawer 20 of a known type having a stack 22 of individual sheets 24 which is filled up therein. The individual sheets 24 are taken off from the high-speed printer in the direction of the arrow 26 by an offtake device not illustrated, in each case the individual sheet 24 lying uppermost on the stack 22 being taken off. The drawer 20 is intended to be filled up by hand, the drawer 20 being grasped at a handle 21 arranged on the front side and being pulled forward in the direction of movement 25. When filling up is being carried out, either the production of the high-speed printer must be stopped or there has to be a changeover to another drawer or another compartment.

Figure 2:
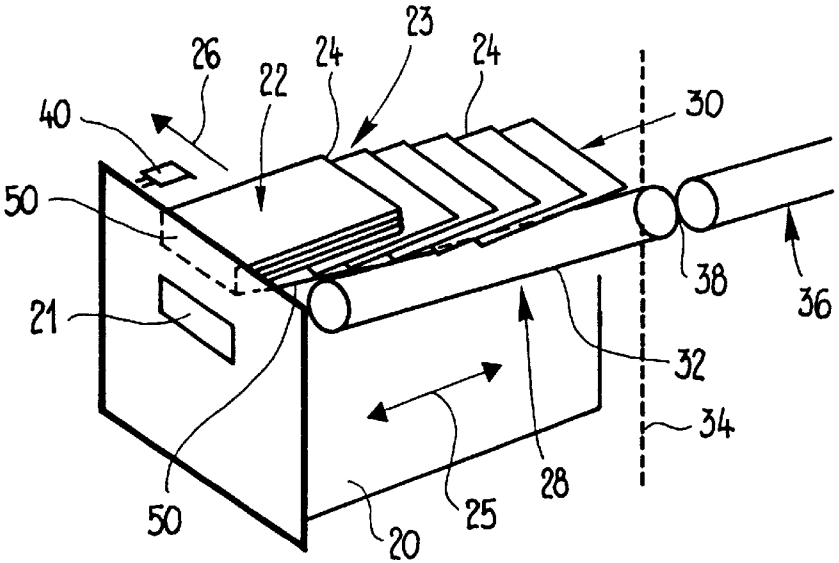
FIG. 2 shows a device according to the invention equipped with a conveying means arranged in the drawer.

FIG. 2 shows an exemplary embodiment of the device according to the invention for feeding individual sheets 24 into the stack well 23 of a printer. In the exemplary embodiment illustrated, a conveying means 28 for conveying the individual sheets 24 and a jogging device 50 for forming a stack 22 from individual sheets 24 are fixedly connected to the drawer 20 or form part of the drawer. The conveying means 28 and the jogging device 50 are designed to interact in such a way that the individual sheets 24 are fed to the stack 22 from below. The jogging device 50 and the conveying means are arranged in such a way that, in the printer, the upper part of the stack 22 is in the position provided for offtake by the paper offtake device. The individual sheets 24 are fed to the stack 22 as an imbricated stream 30 by the conveying means 28. The individual sheets 24 are in a downwardly imbricated position in the imbricated stream 30, so that they are fed to the stack 22 from below, whilst the printer takes them off from the stack 22 on top in the direction of the arrow 26 at right angles to the feed direction. The inner conveying means 28, capable of being extended together with the drawer 20, has an endless transport band 32, on which the individual sheets 24 rest. The jogging device 50 may be designed, for example, solely by the front wall of the drawer 20 or, as illustrated in FIG. 2, as an additional device 50.

Arranged outside the drawer 20 and behind a rear wall 34 of the printer, said rear wall being indicated by a broken line, is a delivery conveyor 36 which delivers the individual sheets 24, already supplied in the imbricated stream, from a store which is not illustrated. Such a delivery conveyor for individual sheets 24 and other conveying elements are described in detail, for example, in EP-A1-0,329,089. This known device also has a deflecting device which deflects the imbricated stream from an upwardly imbricated position into a downwardly imbricated position. The upwardly imbricated position is assumed during the formation of the imbricated stream, when the individual sheets 24 are deposited onto a moving conveyor band. The downwardly imbricated position is necessary in order to feed the individual sheets 24 to the stack 22 from below.

In the exemplary embodiment illustrated, the conveying means 28 runs beyond the rear wall 34. The conveying means 28 could, for example, also be arranged completely within the printer and the delivery conveyor 36 outside the printer, in such a way that the individual sheets 24 can be fed to the printer through a relatively small, for example slotlike orifice. In an advantageous embodiment, the conveying means 28 and the delivery conveyor 36 are arranged relative to one another in such a way that an already existing orifice of the printer can be used for feeding the individual sheets 24.

At a transition point or interface 38 in the region of the rear wall 34 of the printer, the individual sheets 24 are transferred from the delivery conveyor 36 to the inner conveying means 28.

The feed device illustrated comprises two sensors, a checking means 40, for example in the form of a tracer lever or a photocell, for recording the individual sheets 24 taken off from the stack 22 by the offtake device of the printer, and a sensor, not illustrated, for recording the height of the stack 22. When the feed device is put into operation, individual sheets 24 are fed until the stack 22 has a predeterminable height monitored by the sensor. The feeding of the individual sheets 24 is thereupon activated by the signal from the checking means 40. As soon as the checking means 40 detects that an individual sheet 24 has been taken off from the stack 22 on top, the conveying means 28 is activated in such a way that an individual sheet 24 is fed and is pushed into the stack 22 at the bottom. A new individual sheet 24 is thus in each case fed in synchronism with the individual sheet 24 taken off. The height of the stack 22 is adjustable and amounts at least to a single individual sheet 24, but advantageously to a plurality of individual sheets 24.

Since, depending on further processing, the fiber direction in the paper is important, it is advantageous to arrange the conveying means in such a way that the stack can be supplied from three sides.

A printer may also have a plurality of feed devices according to the invention.

Figure 5:
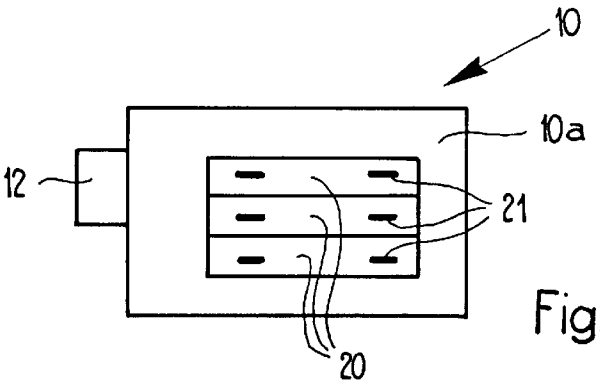
FIG. 5 shows a front view of a copier.

FIG. 5 shows diagrammatically a printer or copier 10 with two known interfaces for the intake of individual sheets, an external input compartment designed as a lift platform 12, and three drawers 20 with handles 21, said drawers being arranged one above the other and each being designed as an internal input compartment. These drawers 20 have the property that, in order to be filled up with individual sheets, they must be pulled outward in the direction of movement 25 at handles 21 which are arranged on the front side 10*a* of the printer 10.

Figure 3:
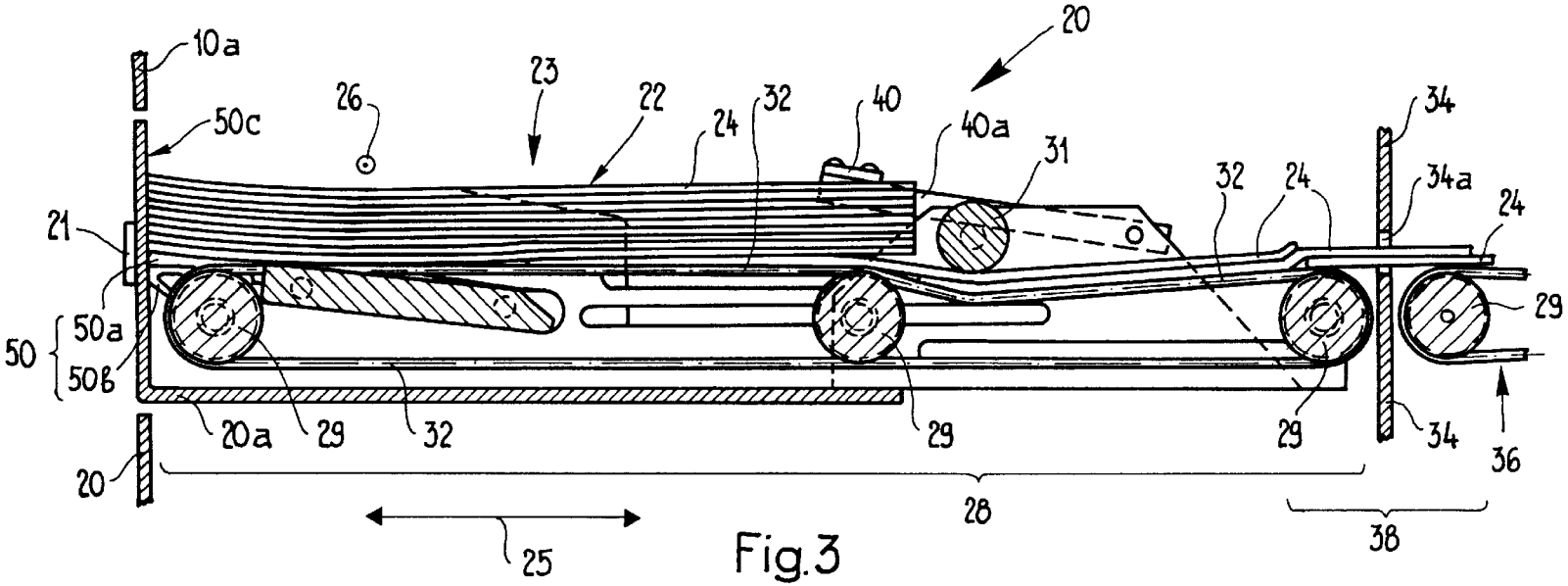
FIG. 3 shows a detailed view of another exemplary embodiment of a drawer.

FIG. 3 shows a further exemplary embodiment of a drawer 20 according to the invention which is inserted into the printer 10 according to FIG. 5, the front side 10*a* and the rear wall 34, with a gap 34*a*, of the printer 10 being evident from the cross section. The drawer 20 comprises a drawer body 20*a* which is of L-shaped cross section and which has a handle 21 on the front side. The drawer body 20*a* has guide means, not illustrated, which guide it in the direction of movement 25 in the printer 10. Fastened to the drawer body 20*a* is a conveying means 28 which guides and conveys an endless transport band 32 by means of at least partially driven rollers 29. The conveying means 28 comprises, moreover, a press-down roller 31 which presses the individual sheets 24, delivered in a downwardly imbricated position, against the transport band 32. Also fastened to the drawer body 20*a* is a jogging device 50 which comprises a supporting ramp 50*a*, a jogging table 50*b* and a stop 50*c* formed by the frontside of the drawer body 20*a*. By virtue of this design of the conveying means 28 and jogging device 50, the individual sheets 24 are fed to the stack 22 from below, so that a stack 22 of individual sheets 24 is formed in the stack well 23 of the printer 10. A tracer lever 40 with a lever arm 40*a* makes it possible to monitor the height of the stack 22. The height sensed thereby is recorded by a measurement transducer, not illustrated, and is fed to a regulating device. Arranged outside the printer 10, on the rear wall 34 of the latter, is a delivery conveyor 36 which delivers the individual sheets 24 to the gap 34*a*, so that they can be transferred to the conveying means 28 at the interface 38 thus formed.

Figure 4:
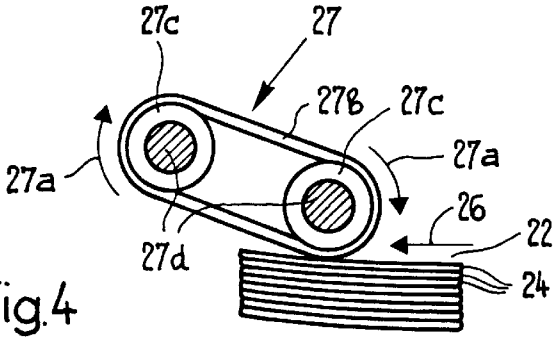
FIG. 4 shows a detailed view of an offtake device for a drawer according to FIG. 3.

FIG. 4 shows an exemplary embodiment of an offtake device 27, by means of which the sheets 24 stacked in the drawer 20 according to FIG. 3 are taken off individually in the direction of movement 26. This offtake device 27 comprises a transport band 27*b* which is movable in the direction of movement 27*a* and which is guided on deflecting rollers 27*c* mounted rotatably about shafts 27*d*.

The advantage of the exemplary embodiment according to FIG. 3 is that this drawer 20 can be introduced into a printer 10 according to FIG. 5 in place of a conventional drawer illustrated in FIG. 1. The drawer according to the invention has the advantage of an automatic sheet feed, this being advantageous particularly when a printer 10 has no external input compartment 12. If a buildup caused by the individual sheets 24 were to occur in the drawer 20 according to the invention, it can be eliminated without difficulty by pulling out the drawer in the direction of movement 25, removing all the individual sheets 24 located in the drawer 20 and then closing the drawer 20 again. The stack 22 is thereupon automatically filled up with individual sheets 24 again by the imbricated stream of individual sheets 24 which is fed via the delivery conveyor 36. The drawer 20 according to the invention can therefore be operated in an extremely user-friendly way.

The gap 34*a* could also be arranged on a side wall of the printer 10, so that the individual sheets are not fed to the stack 22 in the drawer 20 from the rear, but laterally.

In an advantageous method, the imbricated stream of individual sheets 24 is produced by drawing off a web from a roll, for example a large paper roll, at a web speed, cutting the web into individual sheets and feeding the individual sheets as an imbricated stream to the printer via the delivery conveyor 36 at a speed which is reduced, as compared with the web speed.

The drawer 20 according to the invention, with the delivery conveyor 36, advantageously has an independent regulating device which endeavors to keep the stack 22 of individual sheets 24 at a constant height which is always about the same. In an advantageous method, when the stack 22 is full, the drawer 20, with the delivery conveyor 36, is operated in such a way that, for each individual sheet 24 taken of f from the stack by the printer, an individual sheet 24 is fed to the stack 22 in synchronism. The independent regulating device operates preferably in such a way that the printer 10 constantly assumes that a full stack 22 of individual sheets 24 is available. The number of individual sheets 24 located in the stack 22 can be adjusted via the independent regulating device and, for example, may even amount to only 2 to 5 individual sheets 24. In order to ensure optimum adaption to the printer 10, it may provide advantageous for the independent regulating device to monitor particular control or sensor signals of the printer 10, in order to give the printer 10 the impression of a constantly full stack 22, or, if faults occur, in order to react according to the requirements of the printer 10, such as, for example, in the case of the elimination of a paper buildup, as already described.

What is claimed is:

1. A device including a cassette or drawer (20) for receiving individual sheets (24) to be printed in a printer or copier (10), said cassette or drawer (20) being designed to be inserted into a printer or copier (10) provided with an offlake device (27) for extracting the individual sheets (24), from a stack (22), wherein a conveying means (28) for delivering the individual sheets (24) and a jogging device (50) for forming a stack (22) from the delivered individual sheets (24) are arranged within the cassette or drawer (20), the conveying means (28) and the jogging device (50) interacting in such a way that the individual sheets (24) are fed to the stack (22) from below, and the jogging device (50) arranged in such a way that, with the cassette or drawer (20) inserted in the printer or copier (10), the upper part of the stack (22) assumes a take-off position allowing the sheets (24) be withdrawn from the stack (22) from the top.

2. The device as claimed in claim 1, wherein the conveying means (28) is designed for conveying the individual sheets (24) in an imbricated stream.

3. The device as claimed in claim 1, wherein the conveying wherein the conveying means (28) is arranged in such a way that, with the cassette or drawer (20) inserted in the printer or copier (10), the conveying means (28) forms, in the region of a rear wall (34) of the printer or copier (10), a transition point or interface (38) with a delivery conveyor (36) arranged outside the printer or copier (10).

4. The device as claimed in claim 1, wherein the conveying means (28) has a transport band (32) capable of being driven in a controlled manner.

5. The device as claimed in claim 1, wherein a checking means (40) is provided for recording the individual sheets (24) taken off from the stack (22) by the printer or copier (10) and for resupplying the same quantity of individual sheets (24).

6. The device as claimed in claim 1, wherein the feed direction of the individual sheets (24) to be fed to the stack (22) runs at right angles to the offtake direction (26) of the printer or copier (10).

7. The device as claimed in claim 1, wherein the conveying means (28) is fixedly connected to the cassette or drawer (20), and wherein both together are designed to be arranged removably in the printer or copier (10).

8. A printer or copier (10), comprising at least one device as claimed in claim 1.

9. A printer or copier as claimed in claim 8, wherein upstream of the conveying means (28) located in the cassette or drawer (20) a deflection device is arranged supplying the individual sheets (24) in an imbricated conveying stream in which each sheet (24) rests on the following sheet for feeding the sheets (24) to the stack (22) from below.

10. A printer or copier as claimed in claim 8, further comprising a delivery conveyor (36) arranged outside of the printer or copier (10) and upstream of the conveying means (28) located in the cassette or drawer (20), wherein upstream of said delivery conveyor (36) a deflection device is arranged supplying the individual sheets (24) in an imbricated conveying stream in which each sheet (24) rest on the following sheet for feeding the sheets (24) to the stack (22) from below.

11. A method for feeding individual sheets (24) to be printed in a printer or copier (10) into a cassette or drawer (20) of the printer or copier (10), said cassette or drawer (20) being designed to be inserted into a printer or copier (10) and forming a stack well (23), wherein the individual sheets (24) are fed to the stack well (23) in a conveying stream, are layered in the stack well (23) to form a stack (22), and are pushed into the stack (22) from below and are removed from the stack (22) from the top.

12. The method as claimed in claim 11, wherein the individual sheets (24) are fed in an imbricated formation.

13. The method as claimed in claim 11, wherein the individual sheets (24) are fed in a controlled manner in such a way that the height of the stack (22) is kept constant.

14. The method as claimed in claim 11, wherein, for each individual sheet (24) taken off from the stack (22) by the printer or copier (10), an individual sheet (24) is fed to the stack (22) in synchronism.

15. The method as claimed in claim 11, wherein the imbricated stream of individual sheets (24) is produced by drawing off a web from a roll at a web speed, by cutting the web into individual sheets and by feeding the individual sheets as an imbricated stream to the printer at a speed which is reduced, as compared with the web speed.

16. A printer or copier (10), operated by means of a method as claimed in claim 11.

* * * * *